US010301074B2

(12) United States Patent
Yeager et al.

(10) Patent No.: US 10,301,074 B2
(45) Date of Patent: May 28, 2019

(54) BOTTOM AND SIDE GUSSETED PACKAGE AND METHOD

(71) Applicant: Innoflex Incorporated, Birmingham, AL (US)

(72) Inventors: James W. Yeager, Mobile, AL (US); John F. Hogan, Duluth, GA (US)

(73) Assignee: Innoflex Incorporated, Birmingham, AL (US)

( * ) Notice: Subject to any disclaimer, the term of this patent is extended or adjusted under 35 U.S.C. 154(b) by 0 days.

(21) Appl. No.: 15/029,986

(22) PCT Filed: Oct. 9, 2014

(86) PCT No.: PCT/US2014/059836
§ 371 (c)(1),
(2) Date: Apr. 15, 2016

(87) PCT Pub. No.: WO2015/057478
PCT Pub. Date: Apr. 23, 2015

(65) Prior Publication Data

US 2016/0297568 A1 Oct. 13, 2016

Related U.S. Application Data

(60) Provisional application No. 61/891,538, filed on Oct. 16, 2013.

(51) Int. Cl.
*B31B 70/00* (2017.01)
*B65D 30/20* (2006.01)
(Continued)

(52) U.S. Cl.
CPC ..... *B65D 31/10* (2013.01); *B31B 70/00* (2017.08); *B31B 70/81* (2017.08); *B65B 9/2042* (2013.01);
(Continued)

(58) Field of Classification Search
CPC ..... B31B 19/00; B31B 19/90; B31B 37/00; B31B 2219/269; B31B 2219/9006;
(Continued)

(56) References Cited

U.S. PATENT DOCUMENTS 4,055,109 A 10/1977 Kan
4,252,269 A * 2/1981 Peppiatt ..... B65D 33/10 383/10
(Continued)

FOREIGN PATENT DOCUMENTS

DE 102008039953 A1 3/2010
JP H07314581 A 12/1995
(Continued)

OTHER PUBLICATIONS

International Search Report and Written Opinion for corresponding PCT application No. PCT/US2014/059836 dated Jan. 21, 2015.
(Continued)

*Primary Examiner* — Sameh Tawfik
(74) *Attorney, Agent, or Firm* — Wood, Phillips, Katz, Clark & Mortimer

(57) ABSTRACT

A bottom and side gusseted package comprises a package body, a pair of inwardly extending side gussets, and a bottom gusset positioned transversely of a longitudinal axis of the package body. Formation of the gusseted package is effected by positioning individual sleeves transversely of the longitudinal axis of a flexible web which forms the package body. During package formation, the inwardly extending side gussets are formed, and the flexible web is cut to form individual packages, such that each individual sleeve forms a bottom gusset in a respective one of the gusseted packages.

10 Claims, 8 Drawing Sheets

(51) Int. Cl.

| | |
|---|---|
| ***B65B 61/18*** | (2006.01) |
| ***B65B 9/20*** | (2012.01) |
| ***B65B 9/213*** | (2012.01) |
| ***B65D 33/24*** | (2006.01) |
| ***B31B 70/81*** | (2017.01) |
| *B31B 160/10* | (2017.01) |
| *B31B 155/00* | (2017.01) |
| *B31B 160/20* | (2017.01) |
| *B31B 70/26* | (2017.01) |

(52) U.S. Cl.
CPC ..... *B65B 9/2056* (2013.01); *B65B 9/213* (2013.01); *B65B 61/188* (2013.01); *B65D 33/24* (2013.01); *B31B 70/266* (2017.08); *B31B 70/8122* (2017.08); *B31B 70/8133* (2017.08); *B31B 2155/00* (2017.08); *B31B 2155/0012* (2017.08); *B31B 2160/10* (2017.08); *B31B 2160/20* (2017.08)

(58) Field of Classification Search
CPC ..... B31B 2219/9022; B31B 2237/20; B31B 2237/403; B31B 70/00; B31B 70/81; B65B 9/2042; B65B 9/2056; B65B 9/213; B65B 61/188; B65D 31/10; B65D 33/24
USPC ..... 493/218
See application file for complete search history.

(56) References Cited

U.S. PATENT DOCUMENTS

| | | | | |
|---|---|---|---|---|
| 4,266,469 | A | 5/1981 | Feldkamper | |
| 4,539,705 | A * | 9/1985 | Baines | B29C 66/004 383/120 |
| 4,617,683 | A | 10/1986 | Christoff | |
| 4,651,504 | A | 3/1987 | Bentsen | |
| 4,909,017 | A | 3/1990 | McMahon et al. | |
| 4,954,124 | A * | 9/1990 | Erickson | B29C 65/7437 156/308.4 |
| 5,236,531 | A | 8/1993 | Yokoyama | |
| 5,409,441 | A * | 4/1995 | Muscoplat | B43M 5/04 493/220 |
| 5,437,406 | A | 8/1995 | Gordon et al. | |
| 5,826,401 | A | 10/1998 | Bois | |
| 5,902,047 | A | 5/1999 | Yeager | |
| 6,286,191 | B2 | 9/2001 | Van Erden | |
| 6,367,976 | B1 * | 4/2002 | Bannister | B65D 31/04 383/109 |
| 6,425,847 | B1 | 7/2002 | Broenstrup | |
| 6,719,678 | B1 | 4/2004 | Stern | |
| 6,779,921 | B2 | 8/2004 | Yeager | |
| 6,783,276 | B2 | 8/2004 | Machacek et al. | |
| 6,928,791 | B2 | 8/2005 | Ausnit | |
| 6,971,794 | B2 | 12/2005 | Yeager | |
| 7,331,917 | B2 | 2/2008 | Totani | |
| 8,182,407 | B2 | 5/2012 | Yeager | |
| 8,616,768 | B2 | 12/2013 | Inagaki et al. | |
| 8,961,012 | B2 * | 2/2015 | Martin | B65D 33/10 383/10 |
| 2004/0154268 | A1 | 8/2004 | Ausnit et al. | |
| 2004/0258332 | A1 | 12/2004 | Totani | |
| 2007/0092166 | A1 | 4/2007 | Auzini et al. | |
| 2007/0258665 | A1 * | 11/2007 | Greco | B65D 31/10 383/63 |
| 2009/0245699 | A1 | 10/2009 | Steele | |
| 2011/0019943 | A1 | 1/2011 | Piraneo | |
| 2011/0039676 | A1 | 2/2011 | Totani | |
| 2011/0212815 | A1 * | 9/2011 | Totani | B31B 37/00 493/243 |
| 2014/0161373 | A1 * | 6/2014 | Yeager | B65D 33/2533 383/42 |
| 2014/0294326 | A1 | 10/2014 | Yeager | |

FOREIGN PATENT DOCUMENTS

| | | | |
|---|---|---|---|
| JP | 2002046197 | A | 2/2002 |
| JP | 2004161288 | A | 6/2004 |
| JP | 2004189283 | A | 7/2004 |
| JP | 2004203393 | A | 7/2004 |
| JP | 2004292028 | A | 10/2004 |
| JP | 2004306338 | A | 11/2004 |
| JP | 2005263300 | A | 9/2005 |
| JP | 2010105741 | | 5/2010 |
| JP | 2011031946 | A | 2/2011 |
| JP | 2012152901 | A | 8/2012 |
| JP | 2013-100140 | A | 5/2013 |
| JP | 2013144574 | A | 7/2013 |
| WO | 2012099197 | A1 | 7/2012 |

OTHER PUBLICATIONS

Supplementary Partial European Search Report and Provisional Opinion dated Apr. 21, 2017.
Communication enc. Supplementary European Search Report dated Mar. 21, 2017.
Examination Report for corresponding Australian Application No. 2014334749 dated Aug. 29, 2016.
Examination Report for corresponding New Zealand Application No. 719041 dated Aug. 12, 2016.
Machine Translation of Japanese Document No. 2012-152901. dated Feb. 5, 2015.

* cited by examiner

BOTTOM AND SIDE GUSSETED PACKAGE AND METHOD

TECHNICAL FIELD

The present invention relates generally to packages formed from polymeric film webs, and more particularly to a bottom and side gusseted package including at least one bottom gusset positioned transversely of a longitudinal axis of the package, and a pair of opposite inwardly extending side gussets, with the configuration of the package, and its method of formation, permitting use with associated form, fill, and seal equipment.

BACKGROUND OF THE INVENTION

Packages formed from plastic, polymeric film material have found widespread application in the market place for convenient and efficient packaging of all manner of food and non-food products. Packages of this nature typically are formed by folding and sealing a web of polymeric material to form a package body having front and rear package panels, with the package panels joined to each other at margins thereof. Depending upon the method of formation, the front and rear package panels may be joined to each other either by folded portions of the package body, or at seals (typically heat seals) joining the package panels to each other.

Non-gusseted packages of this type are sometimes referred to as "pillow packs", and do not include either side gussets or top or bottom gussets. However, for many applications it is desirable to form a gusseted package that is providing the package with inwardly-extended, pleat-like gussets at one or more margins of the package body. For example, side-gusseted packages include inwardly extending side gussets at opposite lateral sides of the package body, which side gussets join respect lateral edges of the front and rear package panels to each other.

For some applications, it is especially desirable to provide a bottom-gusseted package, that is, a package having an inwardly extending gusset at the bottom of the package body. By virtue of the breadth and stability provided by the bottom gusset, packages of this nature can frequently be configured to be self-standing, promoting efficient display for consumer selection.

Heretofore, bottom-gusseted packages have typically been formed by pleating a web of polymeric material in a direction parallel to the longitudinal axis of the web. Suitable ploughs and forming guides shape and configure the polymeric web as it moves longitudinally, including formation of a continuous, inwardly extending bottom gusset in the web material. Subsequently, suitable seals are formed transversely of the web to define individual package bodies, each including front and rear package panels, with each including a bottom gusset. Individual package bodies are formed by cutting the web of material at the transversely extending seals, with the contents of each package deposited therein either before or after cutting of the web into individual packages. Formation of an upper seal, at the margin of the folded polymeric web opposite the bottom gusset, closes and seals each package body.

As will be appreciated by this typical formation technique, the height or vertical dimension of each package body is approximately equal to one-half of the width of the polymeric web, less the dimension of the bottom gusset. As a consequence, the maximum height of any package being formed is essentially limited by the maximum width of the web of polymeric material which the forming equipment is capable of handling.

The present invention contemplates a bottom gusseted package that is also provided with inwardly extending side gussets, and a method of formation, which addresses the shortcomings in the conventional forming of a bottom-gusseted package. In essence, this is achieved by forming each package with a bottom gusset positioned transversely of the longitudinal axes of the polymeric film web and each package, while also forming inwardly extending side gussets. The bottom and side gusseted packages of any selected height can be readily and efficiently formed.

SUMMARY OF THE INVENTION

A bottom and side gusseted package embodying the principles of the present invention comprises a package body formed from a flexible web having a longitudinal axis. The flexible web is folded to define a front package panel and a rear package of the package body. Inwardly extending side gussets are formed at respective opposite edges of the folded flexible web. The front and rear package panels are joined to each other at respective lateral side margins of the package body at which the inwardly extending side gussets are formed, with the flexible web being joined to itself along a seam which extends parallel to the longitudinal axis of the flexible web.

Notably, a package formed in accordance with the present invention includes at least one bottom gusset positioned between the front and rear package panels, with the bottom gusset extending upwardly and inwardly from the lower edges of the front and rear package panels. By formation of the present package in accordance with the present invention, the bottom gusset is positioned within the package body transversely of the longitudinal axis of the package body, and transversely of the longitudinal axis of the flexible web from which the package body is formed. As a consequence, a package body can be very efficiently formed at any selected height, without necessarily being limited by the width of the flexible web from which the package is formed. Formation of the package with inwardly extending side gussets permits the package to be configured for versatile use, and desirably permits the package to be formed for upstanding, self-standing display.

Notably, the versatility of the method of package formation in accordance with the present invention permits formation of a bottom and side gusseted package in different configurations. In illustrated embodiments, a gusseted package is formed with a single bottom gusset and a pair of inwardly extending side gussets. In these embodiments, the side gussets are either positioned between the bottom gusset and one of the front and rear package panels, or the side gussets extend into the bottom gusset. In an alternative embodiment, a gusseted package is formed with a pair of bottom gussets which are adjacent each other to form a double bottom gusset, with the pair of inwardly extending side gussets extending between the pair of bottom gussets. While formation of the package can be effected so that each package is formed with a sleeve portion at the top of the package, opposite the one or more bottom gussets, it is within the purview of the present invention that the invention be practiced for forming packages with a bottom gusset only, without a top sleeve portion.

The method of formation of a bottom-gusseted package in accordance with the present invention comprises the steps of providing flexible web of material having a longitudinal axis. Suitable polymeric material can be employed by virtue of its liquid-impermeable characteristics, and heat-sealing capabilities.

Together with a flexible web of material, the present method contemplates that a flexible, sleeve-forming web is provided. The sleeve-forming web is folded and generally tubular, and can be configured to provide the bottom gussets, as well a series of top sleeve portions that can form upper package seals, and/or recloseable openings. It is presently preferred that an inside surface of the folded, sleeve-forming web does not heat-seal to itself, thus facilitating formation one or more bottom gussets which spread or open to permit the packages being formed to be generally self-standing. Depending upon the specific application, it can be desirable to form the sleeve-forming web from material which is different that the material of the flexible web.

The present method further comprises the step of cutting the folded, flexible, sleeve-forming web into a plurality of individual sleeves, each having a folded, generally tubular configuration. The individual sleeves are next joined to the flexible web in spaced apart relationship longitudinally of the flexible web, transversely of the longitudinal axis of the flexible web. The longitudinal spacing between individual sleeves on the flexible corresponds to the length of each of the bottom and side gusseted packages being formed. Notably, as will be further described, packages can be configured such that each individual sleeve eventually forms the bottom gusset of one package, and the top sleeve portion of an adjacent one of the packages being formed.

For formation of a package having a pair of adjacent bottom gussets, i.e., a double bottom gusset, a pair of individual sleeves can be provided for each of the packages being formed. The pair of individual sleeves can be joined to the flexible web of material in transversely or laterally spaced relationship to each other.

After the individual sleeves are joined to the flexible web, the flexible web is folded and joined along lateral margins thereof to form a generally tubular, folded flexible web. The individual sleeves are positioned generally within the folded flexible web, in spaced apart relationship. If a pair of the individual sleeves are provided for forming a double bottom gusset, folding of the flexible web of material positions the individual sleeves adjacent to each other after the web has been folded.

Folding of the flexible web material forms a package body for each of the gusseted packages, with each package body including a front package panel and a rear package panel joined at opposite side margins thereof. The individual sleeves are positioned generally within the folded, flexible web.

Inwardly extending side gussets are formed at respective lateral margins of the folded web, either before or after flexible web is joined to form a generally tubular, folded flexible web. Suitable ploughs or the like can be employed, as is known in the art, for forming the opposite, inwardly extending side gussets. The inwardly extending side gussets respectively join the opposite side margins of the front and rear package panels.

Next, the folded flexible web is cut at intervals each corresponding in length to the length of each of the gusseted packages being formed. By this cutting step individual packages are formed so that each individual sleeve provides a bottom gusset for each one of the packages.

In the illustrated embodiments, the cutting step includes cutting through each of the individual sleeves positioned within the folded flexible web so that the cutting step includes cutting through each of said individual sleeves so that a portion of each individual sleeve provides: (1) the bottom gusset for one of the packages being formed, and (2) a top sleeve portion for an adjacent one of said packages being formed. However, depending upon the specific formation technique employed, the individual sleeves within the folded flexible web need not be cut to form a top sleeve portion, in addition to the desired bottom gusset of the package.

By the present invention each of the individual sleeves can be provided with a length which is less than the width of the folded web of flexible material. This facilitates formation of the bottom gusset with a width less than the width of the package, which desirably permits formation of the inwardly extending side gussets between the front and read package panels of each said package at opposite side edges of the package. Side seals of a sufficient width can be formed at opposite ends of the bottom gusset to permit the package to be readily self-standing and stable.

In accordance with the illustrated embodiments, the present method includes joining each of the individual sleeves to the folded flexible web prior to the step of cutting the folded flexible web.

Depending upon the type of package being formed, each top sleeve portion can be provided with a recloseable fastener positioned within the respective top sleeve portion. Each recloseable fastener comprises a pair of fastening elements respectively joined to confronting inside surfaces of each top sleeve portion. The fastener elements may comprises profile fastener elements, adhesive fastener components, hook-and-loop style fastener components, "unisex" self-engaging fastener components, and other releasable fastener arrangements as are known in the art. Alternatively, a recloseable fastener assembly can be provided on the front package panel of the package for facilitating recloseable access to the contents of the package.

Each top sleeve portion can be provided with an upper seal for closing a respective one of the packages being formed, in the presently preferred practice of this embodiment, the upper seal is formed between inturned edges of the respective top sleeve portion.

Other features and advantages of the present invention will become readily apparent from the following detailed description, the accompanying drawings, and the appended claims.

SUMMARY OF INVENTION

Figure 1:
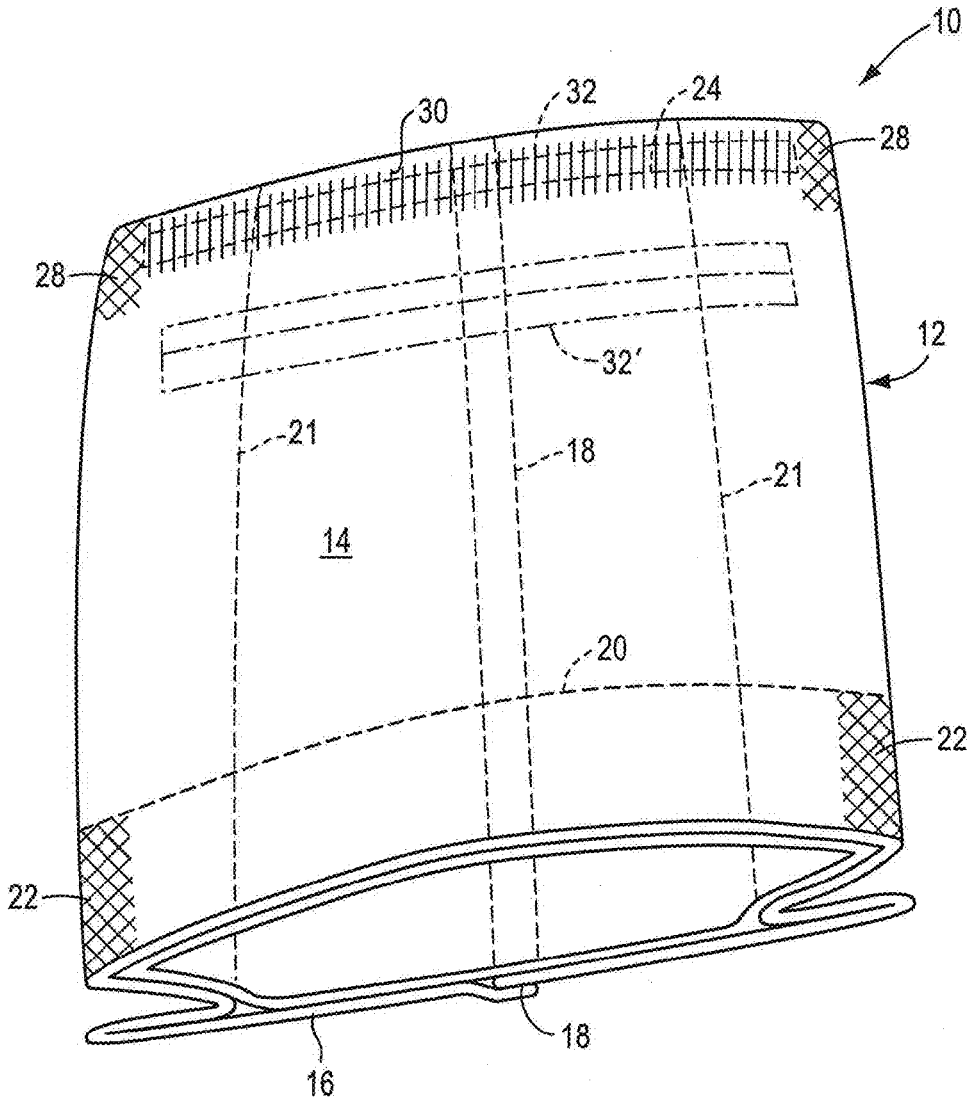
FIG. 1 is a perspective view of a bottom and side gusseted package, which can optionally be configured as a recloseable package, embodying the principles of the present invention.

While the present invention is susceptible of embodiment in various forms, there is shown in the drawings and will hereinafter be described the presently preferred embodiments, with the understanding that the present disclosure should be considered as an exemplification of the invention, and is not intended to limit the invention to the specific embodiments illustrated.

U.S. Pat. Nos. 4,909,017, 4,617,683, 5,902,047, 6,779,921, 6,971,794, and 8,182,407, illustrate various package constructions and formation methods, and are all hereby incorporated by reference.

With reference first to FIG. 1, therein is illustrated a bottom and side gusseted package 10 embodying the principles of the present invention. As will be further described, gusseted package 10 can be configured as a recloseable package, and can include a recloseable fastener at an upper portion of the package, or in a front panel portion of the package. Notably, and as will be further described, package 10 is formed by joining a plurality of individual sleeves to an associated web of flexible material, in spaced apart relationship along the longitudinal axis of the flexible web. Attendant to package formation, each individual sleeve can be cut as individual packages are formed, with each individual sleeve providing a bottom gusset in one package, and optionally, a top sleeve portion, in an adjacent one of the packages being formed. However, the present invention can be practiced without cutting of the individual sleeves, which are configured to provide a bottom gusset for each package being formed.

With further reference to FIG. 1, the gusseted package 10 illustrated therein includes a package body 12 formed from a flexible film web having a longitudinal axis, wherein the flexible web has been folded to define a front package panel 14 and a rear package panel 16 of the package body 12. The front and rear package panels 14 and 16 are joined to each other at respective lateral side margins of the package body 12. In the illustrated embodiment, the front and rear package panels are joined to each other where the flexible film web from which the body is formed has been folded. The flexible film web from which the package body 12 is formed is joined to itself along a longitudinal seam 18 which extends parallel to the longitudinal axis of the flexible web. While seam 18 has been illustrated generally at the middle of rear package panel 16, the flexible web can otherwise be joined to itself, such as at along one of the lateral side margins of the package body.

In accordance with the present invention, package 10 includes a bottom gusset 20 which is positioned between the front and rear package panels 14 and 16, and which extends upwardly and inwardly from lower edges of the front and rear package panels. As will be further described, the pleat-like bottom gusset 20 is formed from a sleeve of material which is positioned within the flexible web from which the package body is formed, with the sleeve of material cut attendant to formation of individual packages.

The gusseted package 10 further includes a pair of inwardly extending side gussets 21 which extending inwardly of the package 10 at respective side edges of the package body 12. The side gussets 21 desirably provide the package 10 with a generally box-like configuration for efficient packaging and display, with the associated bottom gusset 20 desirably providing the package 10 with a self-standing configuration.

In this illustrated embodiment, formation of the package 10 is facilitated by positioning the side gussets 21 between one of the front and rear package panels 14 and 16, and the same side of the bottom gusset 20. As shown in FIG. 1, each side gusset 21 is positioned between the bottom gusset 20 and the rear package panel 16.

The bottom gusset 20 is joined to and integrated with the package body by a pair of side seals 22 at opposite lateral margins of the package body, and a pair of end seals which respectively join the edges of the bottom gusset 20 to the front and rear package panels 14 and 16. Suitable seals are further provided for joining the bottom gusset 20 to the respective side gussets 21. It is presently contemplated that the bottom gusset 20 be configured to have a width less than that of the package 10, which permits the formation of side seals 22. This permits the formation of a stable and self-standing package, by closing the opposite ends of the bottom gusset. This can be desirable if the inwardly facing surfaces of the bottom gusset do not heat-seal to each other.

In accordance with this illustrated embodiment, the bottom and side gusseted package 10 can configured for recloseable use. To this end, the package 10 can include a top sleeve portion 24 positioned between the front and rear package panels 14 and 16, at the upper end of the package body 12. The top sleeve portion 24 preferably includes a sleeve seal, which may be configured as a so-called "peel seal", or otherwise configured for separation attendant to initial opening of the package. The top sleeve portion 24 can be otherwise configured to permit access to the contents of the package through the top sleeve portion, such as by the provision of a preferentially weakened region. The top sleeve portion 24 is joined to and integrated with the package body 12 by side seals 28 joining respective opposite ends of the sleeve portion 24 to the package body generally at opposite, lateral side margins thereof. A pair of top seals 30, respectively join the pair of legs or flanges of the top sleeve portion 24 to the front and rear package panels 14, 16.

In this embodiment, the top sleeve portion 24 includes a recloseable fastener, shown in phantom line at 32. The recloseable fastener includes first and second fastener elements configured for releasable securement to each other, with the fastener elements respectively joined to the legs or flanges of the top sleeve portion 24. Thus, the sleeve portion 24 provides first and second mounting flanges for the first and second fastener elements, with the flanges respectively positioned inwardly of and joined to the front and rear package panels.

As will be appreciated, access to the contents of the package 10 is provided via the top sleeve portion 24 and recloseable fastener 32. For opening, the legs or flanges of the top sleeve portion 24 are separated, and the first and second fastener elements of the recloseable fastener 32 separated. For initial opening of the package, the sleeve seal is opened and separated, with access to the interior of the package 10 thus provided. By merely pressing the legs or flanges of the sleeve portion 24 together, and urging the components of the recloseable fastener 32 together, the package 10 can be easily reclosed. As noted, the sleeve seal may comprise a so-called "peal seal", and is eventually positioned between the mounting flanges for the fastener 32 provided by the opposite legs of the legs of the sleeve portion 24. The sleeve seal can provide tamper-evidence to provide visually discernible evidence of the initial opening to the package 10.

Recloseable fastener 32 preferably comprises a pair of interlocking profile fastener elements. Such fastener elements may be identically configured, or complementary. Adhesive fastener components, hook-and-loop fastener components, "unisex" self-engaging fastener components, or like recloseable fastening arrangements can be employed for the recloseable fastener 32.

As an alternative to the provision of a recloseable fastener assembly at the top of package 10, a recloseable fastener assembly can be provided on the inside surface of the front package panel 14, as shown in phantom line at 32'. A package having a so-called "front panel" recloseable fastener can be configured in accordance with afore-mentioned U.S. Pat. No. 6,779,921, with the front package panel 14 being openable to permit access to the fastener assembly 32' for accessing, and reclosing, the contents of the package.

For package formation, a flexible web 40 preferably comprising heat-sealable polymeric material is provided, with a flexible web typically advanced in a direction along its longitudinal axis. Formation of the present bottom and side gusseted package is further effected by providing a flexible, sleeve-forming web, also preferably comprising suitable polymeric, heat-sealable material. The composition of the sleeve-forming web can differ from the flexible web 40 for forming the package of the body, as may be desired. By way of example, the sleeve-forming material can be selected to exhibit certain gas permeability characteristics, or even be perforated, which can be desirable for some types of packaging. Perforated plastics allow gas exchange and prevent excess humidity, while solid plastics create a better product seal for modifying atmosphere and reducing available oxygen respiration and ripening, thus extending product shelf life.

It is presently contemplated that only one side of the sleeve-forming web be heat-sealable, so that the inside surface of the folded, sleeve-forming web does not heat seal to itself. This permits the eventual opening and spreading of the legs of the bottom gusset 20 so that the package 10 can assume a generally self-standing orientation.

The sleeve-forming web may be provided with a tubular configuration, including the sleeve seal releasably joining lateral edges of the sleeve-forming web. The sleeve-forming web can provided with recloseable fasteners 32, which may be provided in either continuous form, or as segmented, pre-cut lengths. The recloseable fastener elements are positioned generally within the sleeve-forming web, preferably in interconnected relationship.

As illustrated, individual sleeves 44 are cut from the sleeve-forming web, and are positioned transversely of the longitudinal axis of the flexible web 40 from which the package body is formed. For some applications, it can be desirable to seal the ends of each individual sleeve 44, such as with suitable adhesive. The individual sleeves 44 are joined to the flexible web 40 in spaced apart relationship longitudinally of the web 40. The spacing between the individual sleeves 44 corresponds to the length of each of the bottom and side gusseted packages 10 being formed. The ends of each sleeve 44 are joined, such as by heat-sealing, to the web 40. Transverse seals care also be formed between the web 40 and the sleeve 44 extending generally parallel to the optional fastener 32 along opposite side margins thereof.

Figure 5:
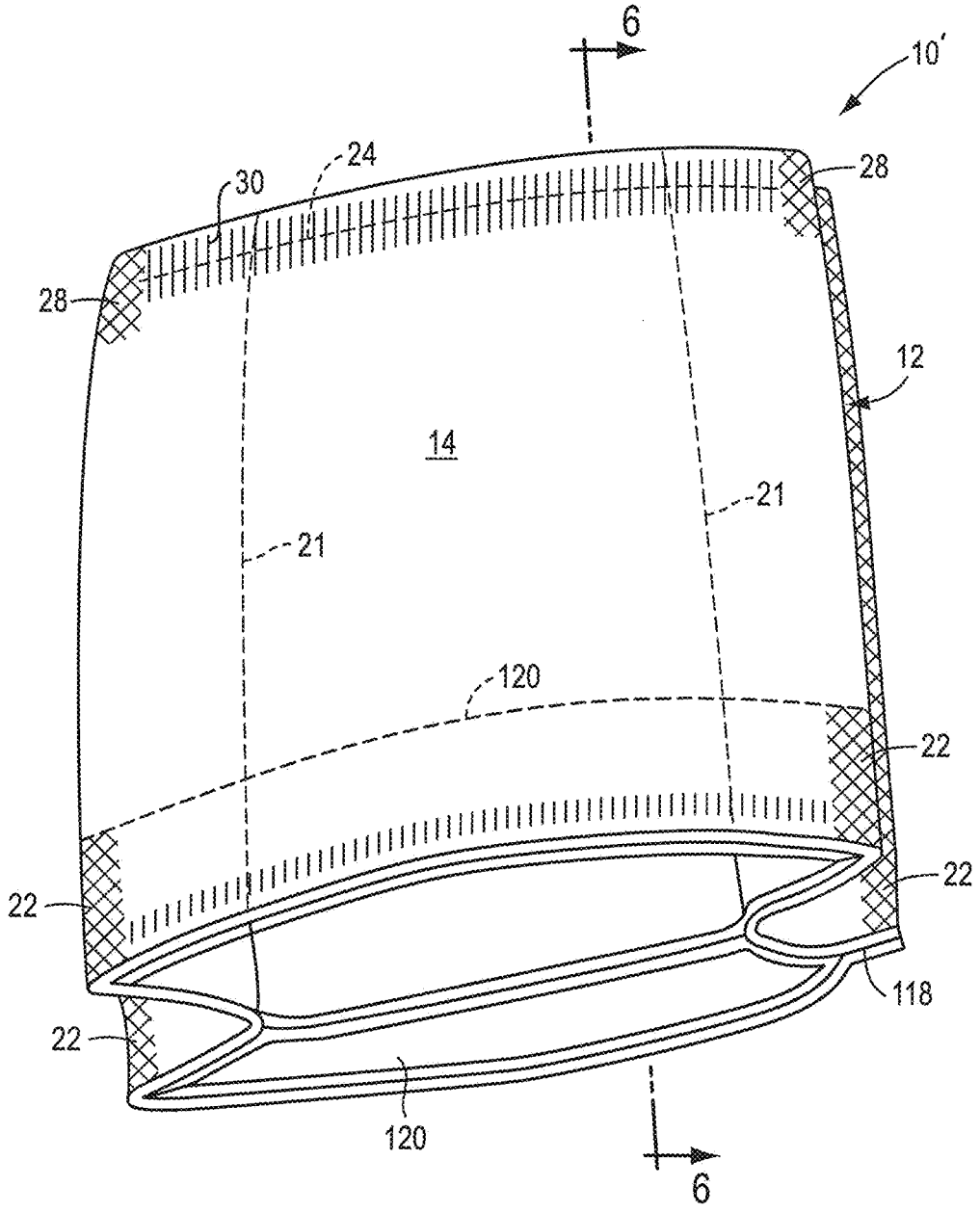
FIG. 5 is a perspective view of a further embodiment of a bottom and side gusseted package, having a double bottom gusset, embodying the principles of the present invention.
Figure 6:
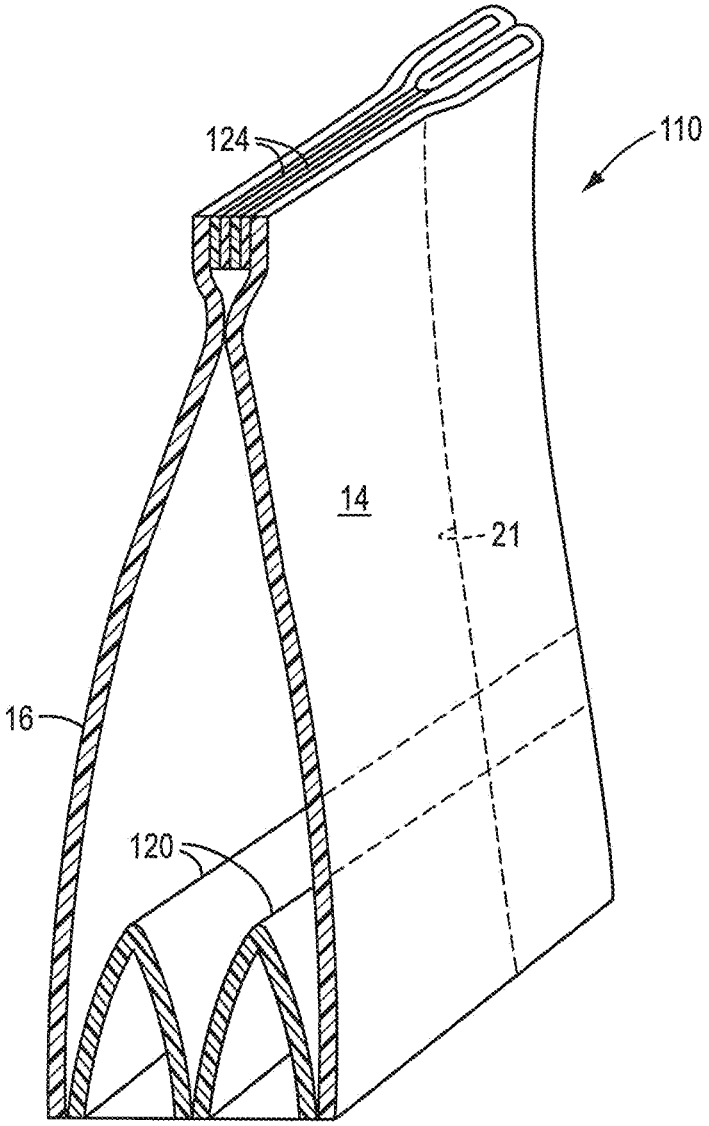
FIG. 6 is a cross-sectional view taken generally along, lines 6-6 of FIG. 5.

After each of the individual sleeves 44 is joined to the flexible web 40, the flexible web is folded and the lateral margins thereof joined together to form a folded flexible web (see FIGS. 5 and 6). In this way, a package body is formed for each of the bottom-gusseted packages. By folding of the flexible web 40, the front and rear package panels 14 and 16 of each package are formed. The folded flexible web 40 can be joined to itself so as to form back seam 18, with the front and rear package panels joined to each other at the folded, lateral margins of the folded web. As illustrated, the individual sleeves 44 are positioned within the folded flexible web 40.

In conjunction with formation of the folded web 40, the inwardly extending side gussets 21 are formed generally at the opposite side margins of the folded web. Suitable ploughs or the like can be employed for formation of the essentially continuous inwardly extending side gussets. As noted, in this illustrated embodiment, the side gussets 21 on formed so that they will eventually be positioned between either the front or rear package panel, and a respective front or rear leg of the bottom gusset 20 (such as between the rear leg of the bottom gusset 20 and the rear package panel 16, as shown in FIG. 1).

Figure 2:
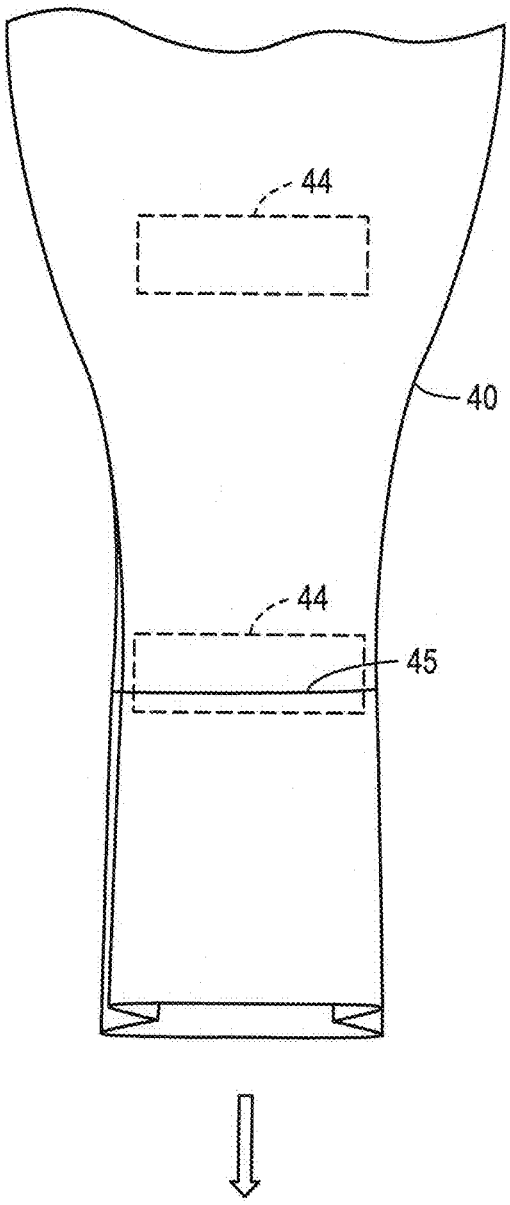
FIG. 2 is a diagrammatic view illustrating formation of the package shown in FIG. 1, in accordance with the present invention.

Notably, the present invention contemplates that each individual sleeve 44 spans and extends between two adjacent ones of the packages being formed, with subsequent cutting of the flexible web into individual packages resulting in each individual sleeve 44 providing a bottom gusset 20 for one package, and a top sleeve portion 24 for an adjacent one of the packages. FIG. 2 illustrates the manner in which each individual sleeve 44 extends between adjacent ones of the packages, with cutting of the folded flexible web 40 at cut 45 transversely of its longitudinal axis to form individual packages, including cutting through each sleeve portion 44 to form a bottom gusset 20 for one package, and a top sleeve portion 24 for an adjacent package. It is presently contemplated that formation in this manner can be effected, if desired, during packaging on a form, fill, and seal machine, or that individual packages can be formed for subsequent filling. Depending upon the specific formation technique, side seals 22 and 28 are typically formed prior to filling, with one of the transverse end seals of the package formed after the contents of each package have been positioned therein.

It is contemplated that the dimensioning of the bottom gusset of the present package, and the manner in which it is configured, accommodate the typical operating parameters of a vertical form, fill and seal machine. As will be recognized by those familiar with the art, this type of machine intermittently advances packaging material through the machine, with typical variation with respect to the web-cutting apparatus being plus/minus 0.25 inches. Thus, a typical sleeve portion 44 can be provided with a folded width, of approximately 3 inches, with seals formed joining each sleeve portion 44 to the web 40. These seals would typically each have a 1.0 inch dimension. When the web is cut, the cut can be formed at the center of this 1.0 inch seal, so that seals each having a width of 0.5 inches are formed. However, because of the typical variation in the operation of the apparatus, i.e. plus/minus 0.25 inches, the exact dimensions of the bottom gusset 20 and top sleeve portion 24 can vary from one package to another. As will be appreciated, this dimensioning is meant to be illustrative, but it will be recognized that the present invention can readily be practiced to accommodate this typical cutting position variation of a vertical form, fill and seal machine.

Figure 3:
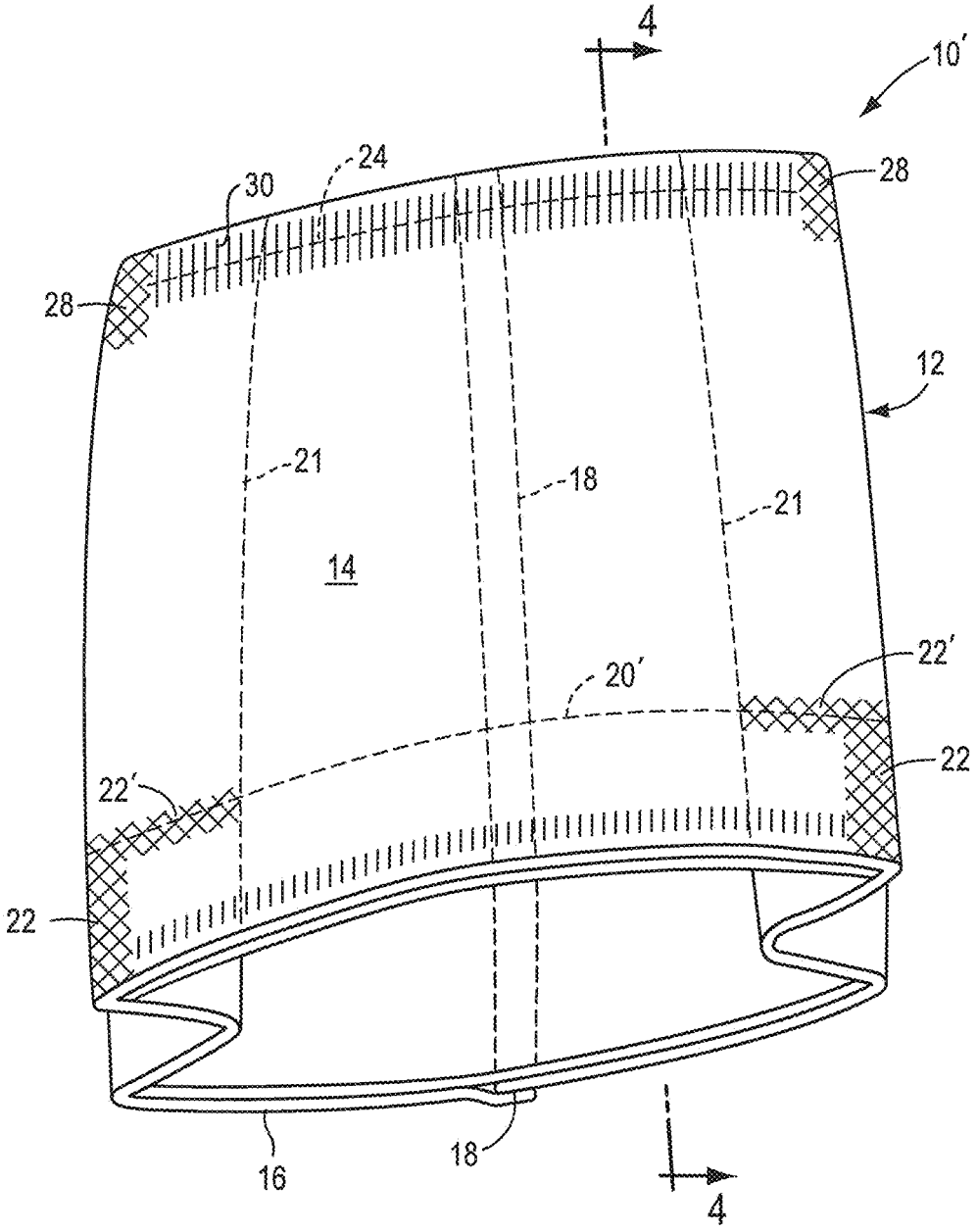
FIG. 3 is a perspective view similar to FIG. 1, illustrating an alternate embodiment of the gusseted package embodying the principles of the present invention.
Figure 4:
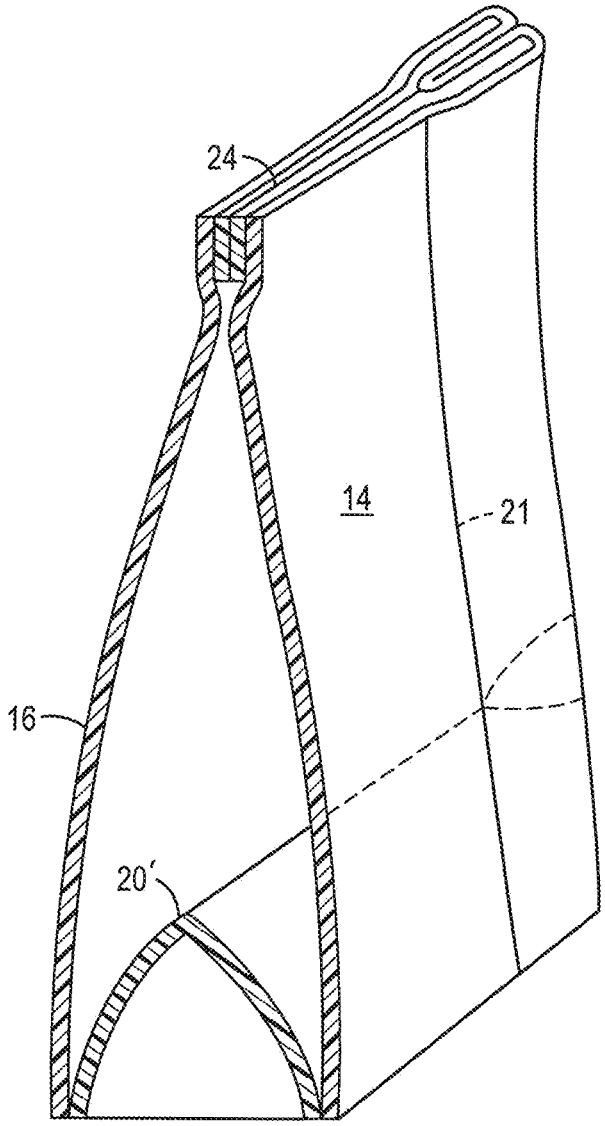
FIG. 4 is a cross-sectional view taken generally along lines 4-4 of FIG. 3.

With reference now to FIG. 3-4, therein is illustrated an alternate embodiment of the present bottom-gusseted package, designated 10'. In most respects, bottom and side gusseted package 10' is like the previously-described embodiment, with the exception that the opposite ends of the bottom gusset, designated 20', have been cut or otherwise opened so that the legs are separated. This, is turn, permits the associated side gussets 21 to extend into the opposite ends of the bottom gusset, rather that extending to the front or rear of the bottom gusset, as in the previous embodiment. Seals 22' are provided between the ends of each of the legs of the bottom gusset 20', and each of the inwardly extending side gussets 21 for closing the bottom of the package.

Figure 7:
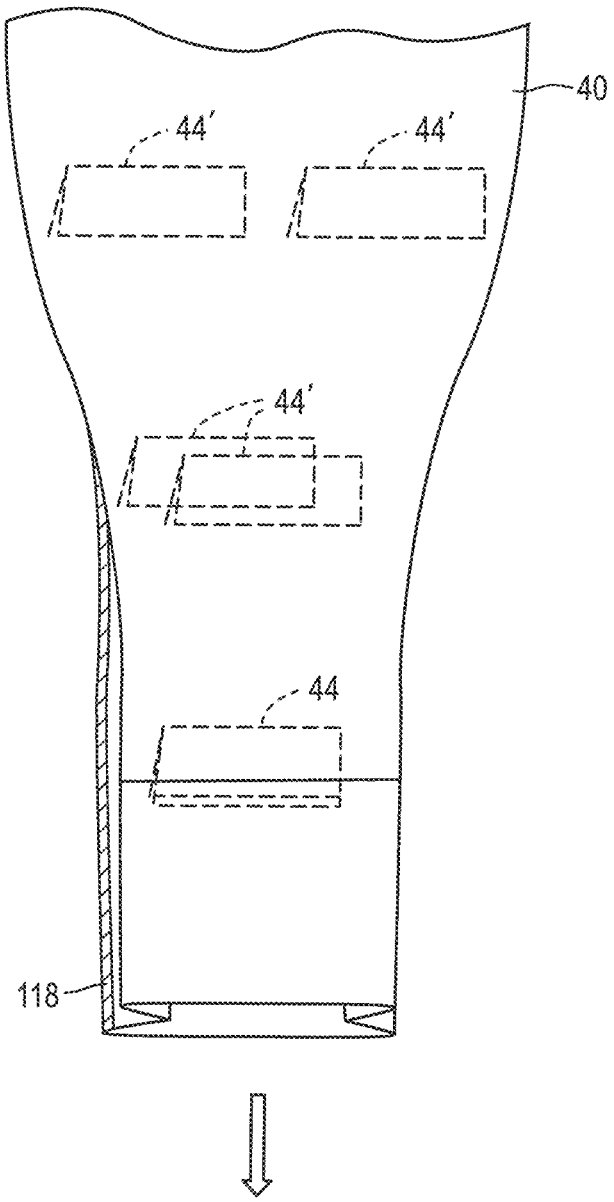
FIG. 7 is a diagrammatic view further illustrating formation of the embodiment of the present package shown in FIG. 5.

With reference now to FIG. 5-7, therein is illustrated a further alternate embodiment of the present bottom and gusseted package, designated 110. In most respects, bottom and side gusseted package 110 is like the previously-described embodiment. Notably, this embodiment includes a double bottom gusset arrangement, comprising a pair of bottom gusset elements each designated 120, between which the associated side gussets 21 to inwardly extend.

The double bottom gusset arrangement is formed by providing with a pair of gusset-forming sleeve portions during package formation. Attendant to formation and cutting of the flexible web from which each package is formed, a pair of top sleeve portions 124, together comprising four plies of material, will be provided at the top of each package 110'. Additionally, formation of this embodiment of the present bottom and side gusseted package is preferably effected by folding the flexible web of material so that a seam for closing the web is formed at one of the side margins of the web. Thus, package 110 includes a longitudinal seam 118, rather than the back seam 18 of the previous embodiments.

It is contemplated that this embodiment can be efficiently formed since the inwardly extending side gussets 21 of the package can be provided to extend inwardly of each package between the associated pair of bottom gusset elements 120. Side seams 22 can be provided at the opposite ends of each of the bottom gussets 120. One of the side seams 22 can optionally be formed at the seam 118.

Formation of bottom-gusseted package 110 is illustrated in FIG. 7, and is generally the same as the method of formation of previously-described package 10. A flexible web 40 of suitable polymeric material is advanced in a direction corresponding to the longitudinal axis of the web. A flexible, sleeve-forming web is provided for forming a pair of individual sleeves 44', Each individual sleeve 44 provides one of the pair of bottom gusset elements 120, and one of the pair of top sleeve portions 124.

As in the previous embodiments, the flexible, sleeve-forming web is cut to form pairs of the individual sleeves 44', with each pair of sleeves then joined to the flexible web 40 in spaced apart relationship longitudinally of the flexible web. Longitudinal spacing between each pair the sleeves corresponds to the length of each of the bottom and side gusseted packages being formed. In order to provide each package with the contemplated double gusset arrangement, the pair of individual sleeves 44 are positioned in laterally spaced relationship to each other on the flexible web 40. Thereafter, the flexible web 40 is folded, thereby bring the sleeves 44' of each pair into confronting, adjacent relationship with each other. The folded flexible web is joined and sealed to itself to form a tubular structure, with this longitudinally formed seam providing the seam 118 of each package. The inwardly extending side gussets are formed at the opposite side margins of the folded web so that the side gussets intend inwardly between the pair of sleeves 44' for eventual disposition of the side gussets of each package between the double bottom gusset of the package.

After the flexible web 40 is joined to itself to form a tubular structure, with the individual sleeves 44' positioned therein, the assembled components are cut transversely of the longitudinal axis of the flexible web to form the individual packages 110. Attendant to cutting in this fashion, each of the pairs of individual sleeves 44' are cut to form the double bottom gussets elements 120, and the pair of top sleeve portions 124.

Figure 8:
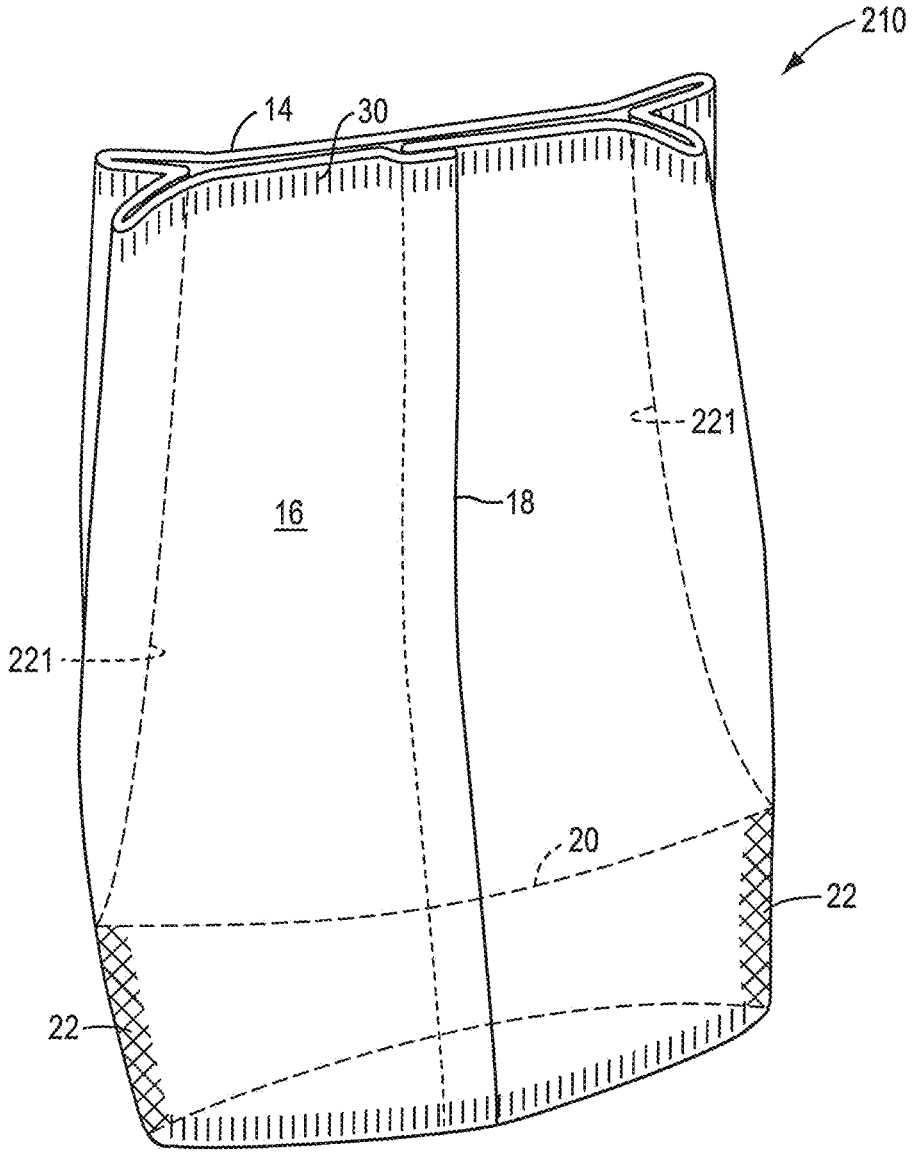
FIG. 8 is a perspective view of a further embodiment of a gusseted package, configured in accordance with the present invention, including partial side gussets.

With reference now to FIG. 8, therein is illustrated a further alternate embodiment of the present bottom and side gusseted package, designated 210. In many respects, bottom-gusseted package 210 is like the previously-described embodiments. However, this embodiment include inwardly extending side gussets 221 which do not extent the full length of the package 10, and terminate at the upper portion of bottom gusset 20. By this arrangement, the package 210 still exhibits the desired "self-standing" characteristics by virtue of the manner in which the legs of the bottom gusset can spread apart and open.

In FIG. 8, the package 210 is oriented such that the rear package panel 16 is visible, with seam 18 extending longitudinally of the package. Top seal 30 can be formed so that the inwardly extending side gussets 221 are generally open at the top of the package. Side seals 22 can be provided joining the front package panel 14 to the rear package panel 16 so that bottom gusset 20 is closed at the opposite ends thereof. As shown, the depth of inwardly extending side gussets can decrease from the top seal from the top seal 30 to the side seals 22, with the gussets terminating at the side seals 22.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making gusseted packages, comprising the steps of:

providing a flexible web of material having a longitudinal axis, providing a flexible, sleeve-forming web;

cutting said flexible, sleeve-forming web into a plurality of individual pairs of sleeves;

joining said pairs of individual sleeves to said flexible web in spaced apart relationship longitudinally of said flexible web, with the longitudinal spacing between said pairs of individual sleeves corresponding to the length of each of said gusseted packages being formed, sleeves of each said pair of individual sleeves being positioned in laterally spaced relationship to each other on said flexible web;

folding said flexible web of material, thereby bringing the sleeves of each of the pairs of individual sleeves into confronting, adjacent relationship with each other, and joining lateral margins of the flexible web to form a folded flexible web, and to thereby form a package body for each of said gusseted packages, each package body including a front package panel and a rear package panel joined at opposite side margins thereof, each said pair of individual sleeves being positioned generally within said folded flexible web;

forming a pair of inwardly extending side gussets from said flexible web of material at respective opposite edges of said folded flexible web; and cutting said folded flexible web at intervals each corresponding to a length of each of said gusseted packages wherein each individual sleeve provides a bottom gusset to each one of the packages being formed, including providing each of said gusseted packages with a pair of said sleeve portions to form each of said packages with a double bottom gusset comprising a pair of bottom gussets, and positioning each of said inwardly extending side gussets to extend between the respective pair of bottom gussets.

2. A method of making bottom-gusseted packages in accordance with claim 1, wherein said cutting step includes cutting through each of said individual sleeves wherein a portion of each individual sleeve provides: (1) said bottom gusset to each one of the packages being formed, and (2) a top sleeve portion to an adjacent one of said packages being formed.

3. A method of making bottom-gusseted packages in accordance with claim 2, including:

providing each of said top sleeve portions with a recloseable fastener positioned within the respective top sleeve portion, each said recloseable fastener comprising a pair of fastener elements respectively joined to confronting inside surfaces of each top sleeve portion.

4. A method of making bottom-gusseted packages in accordance with claim 1, wherein each of said individual sleeves has a length which is less than a width of the folded web of flexible material to facilitate formation of said inwardly extending side gusset.

5. A method of making bottom-gusseted packages in accordance with claim 1, including:

joining each of said individual sleeves to said folded flexible web prior to said step of cutting said folded flexible web.

6. A method of making bottom-gusseted packages in accordance with claim 1, including:

positioning each of said inwardly extending side gussets between the respective bottom gusset and the same one of said front and rear package panels.

7. A method of making bottom-gusseted packages in accordance with claim 1, including:

positioning each of said inwardly extending side gussets to extend into the respective bottom gusset.

8. A method of making bottom-gusseted packages in accordance with claim 1, including:

joining the lateral margins of said flexible web to form said folded flexible web by forming a seal which extends along a side edge of one of said front and rear package panels.

9. A method of making bottom-gusseted packages in accordance with claim 1, wherein:

said sleeve-forming web comprises a folded web of sleeve-forming material, wherein an inside surface of said folded sleeve-forming web does not heat-seal to itself.

10. A method of making bottom-gusseted packages in accordance with claim 1, wherein:

said sleeve-forming web is made from a material which is different than said flexible web.

* * * * *